United States Patent [19]

Swift

[11] Patent Number: 4,500,124

[45] Date of Patent: Feb. 19, 1985

[54] SEAL OF THE PADLOCK TYPE

[75] Inventor: Allan W. Swift, Denville, N.J.

[73] Assignee: E. J. Brooks Company, Newark, N.J.

[21] Appl. No.: 457,235

[22] Filed: Jan. 13, 1983

[51] Int. Cl.[3] ..... B05D 33/34

[52] U.S. Cl. ..... 292/318

[58] Field of Search ..... 292/307, 308, 315, 316, 292/317, 318, 319, 320, 321, 322, 326

[56] References Cited

U.S. PATENT DOCUMENTS

| | | | |
|---|---|---|---|
| 894,278 | 7/1908 | Murray | 292/320 |
| 954,271 | 4/1910 | Edgar | 292/320 |
| 1,964,015 | 6/1934 | Wenk | 292/320 |
| 2,140,320 | 12/1938 | Keidel | 292/318 |
| 3,966,247 | 6/1976 | Muller, Jr. et al. | 292/318 |
| 4,278,281 | 7/1981 | Moberg | 292/320 |
| 4,460,203 | 7/1984 | Moberg et al. | 292/318 |

*Primary Examiner*—Richard E. Moore

*Attorney, Agent, or Firm*—Robert E. Ross

[57] ABSTRACT

A seal of the padlock type comprising a plastic body having a pair of spaced apertures for receiving straight ends of a wire shackle. A metal fastener is assembled in the housing, said fastener having flexible tongues for so engaging the shackle ends that they can be easily pushed into the housing but cannot thereafter be retracted. In one embodiment of the invention the body is formed of upper and lower body portions which retain the fastener therebetween. The fastener and the upper body portion have weakened portions which fracture when excessive tension is applied to the shackle.

In another embodiment of the invention the fastener has transverse score lines and the upper portion of the body has corresponding weakened portions, so that excessive tension applied to either shackle leg will cause fracture of the fastener and the body.

5 Claims, 11 Drawing Figures

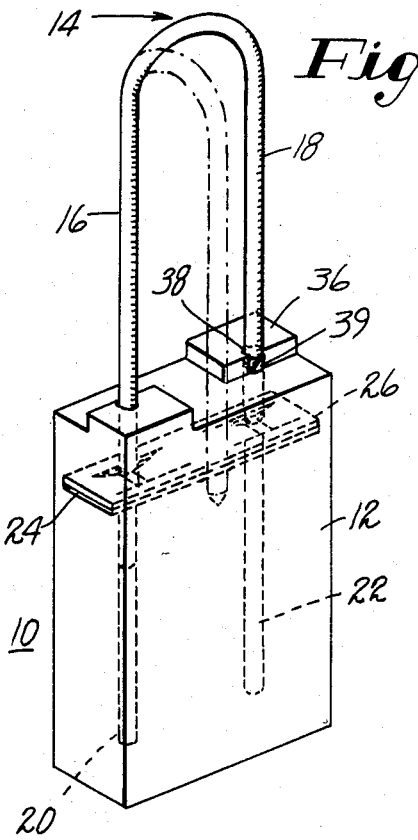
Fig. 1
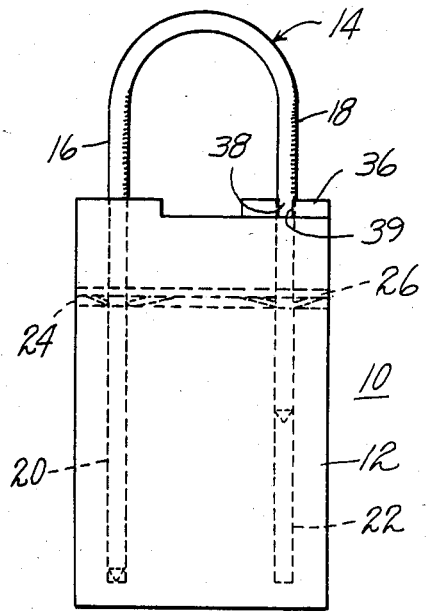
Fig. 4
Fig. 2
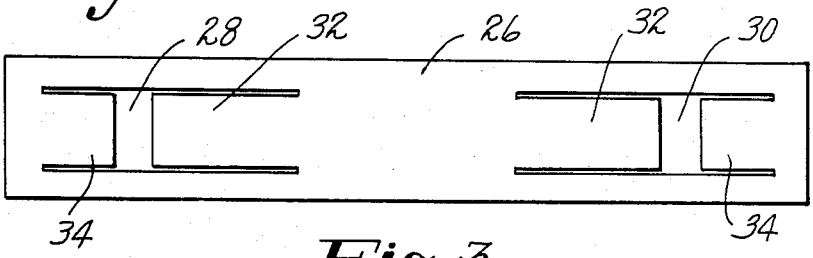
Fig. 3
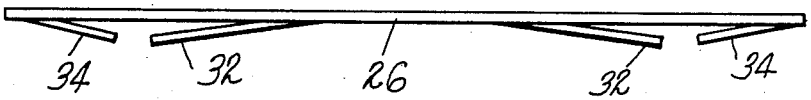

SEAL OF THE PADLOCK TYPE

BACKGROUND OF THE INVENTION

Seals of the padlock type are widely used in the electrical utility industry to seal electric meters and in many other application. Such seals in common use comprise a plastic body having a pair of spaced apertures, and a straight wire shackle having reverse bent ends that are non-removably inserted into the apertures. Such seals are disclosed in U.S. Pat. Nos. 3,485,521 and 4,278,281.

However there are many applications in which seals of this type cannot be used, in some cases because of the thickness of the wire shackle, and in other cases, because the dimensions and configuration of the device to be sealed do not allow the bent end of the shackle to be inserted through the apertures in the device to be sealed.

Also, in some instances such devices have been removed without leaving evidence of tampering.

SUMMARY OF THE INVENTION

This invention provides a seal of the padlock type comprising a plastic body having a pair of spaced apertures for receiving straight ends of a wire shackle. A metal fastener is assembled in the housing, said fastener having flexible tongues for so engaging the shackle ends that they can be easily pushed into the housing but cannot thereafter be retracted.

In one modification of the invention the plastic housing has a transverse aperture intersecting the shackle receiving apertures for receiving a metal fastener having a pair of spaced shackle engaging portions. In another modification of the invention, the plastic body is formed of two pieces, which are assembled with a metal fastener disposed therebetween for receiving and engaging the ends of the shackle. In a preferred embodiment of the invention the fastener and the upper body portion have weakened portions which fracture when excessive tension is applied to the shackle.

In one form of the second modification, the fastener has a pair of spaced transverse score lines and the upper body portion has a pair of corresponding weakened portions so that excessive tension applied to either shackle will cause fracture of the fastener and an end of the upper portion of the body.

Means is provided for retaining the shackle, prior to assembly onto an article to be sealed, in a closed configuration to prevent tangling of the seals with each other during shipment.

BRIEF DESCRIPTION OF THE FIGURES OF THE DRAWING

FIG. 1 is a perspective view of a seal embodying the features of the invention.

FIG. 2 is an enlarged top plan view of the metal fastener portion of the seal.

FIG. 3 is a view in side elevation of the fastener of FIG. 2.

FIG. 4 is a front plan view of the seal of FIG. 1 in the sealed condition.

DESCRIPTION OF THE ILLUSTRATED EMBODIMENTS

Figure 5:
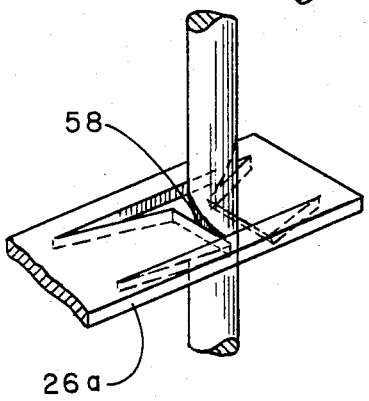
FIG. 5 is an enlarged view of a shackle of the seal in engagement with the fastener of FIGS. 2 and 3.

Referring to FIGS. 1 and 4 of the drawing, there is illustrated a seal 10 of the padlock type, which comprises a plastic body 12 and a wire shackle 14 having long and short straight legs 16 and 18 respectively.

In the embodiment of FIGS. 1 and 4 the body 12 has a pair of spaced apertures 20 and 22 to receive the shackle legs 16 and 18, and a transverse opening 24 entending from a side edge of the body 12 and intersecting the apertures 20 and 22. Assembled into the transverse aperture 24 is a fastener 26, which is preferably formed of spring steel, and has two shackle receiving apertures 28 and 30, each formed by opposing long and short spring tongues 32 and 34.

During manufacture of the seal of FIGS. 1 and 4 the fastener 26 is inserted into the transverse opening 24, and the shackle 14 is then inserted into aperture 20 until it passes through the opening 28 in the fastener. The tongues 32 and 34 are initially inclined downwardly to facilitate such insertion and the dimensions of the components are such that the diameter of the shackle leg is greater that the opening between the tongues. Hence entry of the shackle leg between the tongues causes them to flex downwardly to increase the size of the opening therebetween. Thereafter a pulling force applied to the shackle leg causes the tongues to tend to close to cause the ends to bite into the shackle leg to prevent withdrawal thereof. On initial assembly the shackle is inserted into the seal body only until the end of the shorter shackle leg 18 is at the top surface of the seal body. It has been found desirable to maintain the end of the shackle leg 18 positioned directly above and closely adjacent the top of the seal body, to prevent tangling of the seals with each other during handling and shipment.

For this purpose an abutment 36 is provided on the top of the seal body, said abutment having a recess 38 with a restricted entrance 39 so that the shackle may, during assembly, be pushed into the seal body until the end of leg 18 enters the recess 38. Thereafter the leg 18 is retained in the entrance by the restricted entrance 39 during handling and shipment, yet may be prepared for use in forcing the end of the leg 18 out of the recess by rotating the shackle about the leg 16. Thereafter the leg 18 may be inserted through the device to be sealed, rotated back into the recess 38, and pushed down into the seal body into engagement in the aperture 30 of the fastener. Thereafter the shackle cannot be removed without destroying the seal. In a preferred embodiment of the invention, the fastener is formed of spring steel and the shackle is formed of aluminum, so that if too great a pulling force is applied to the assembled shackle, the tongues of the fastener will bite into the shackle and weaken it sufficiently to cause it to break, thus giving evidence of tampering.

Figure 6:
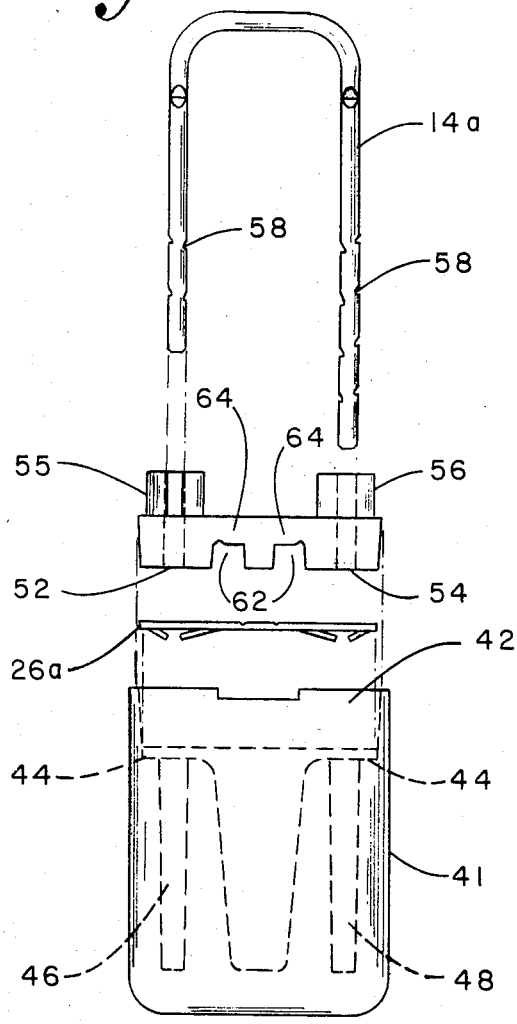
FIG. 6 is an exploded view of a modified form of seal embodying the features of the invention.
Figure 8:
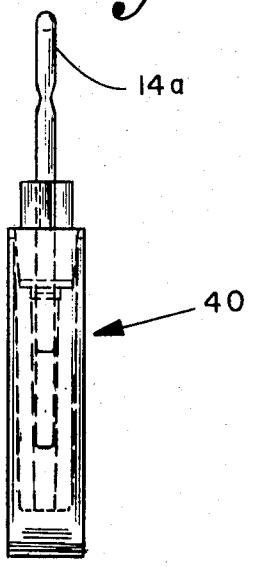
FIG. 8 is a view of the seal of FIG. 7 as seen from the right side.
Figure 11:
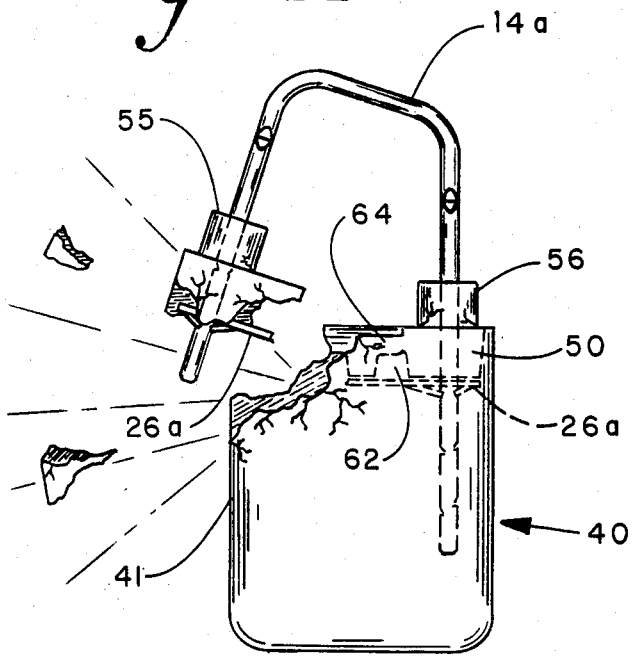
FIG. 11 is a view similar to FIG. 7 illustrating the effects of applying excessive tension to the shackle.
Figure 9:
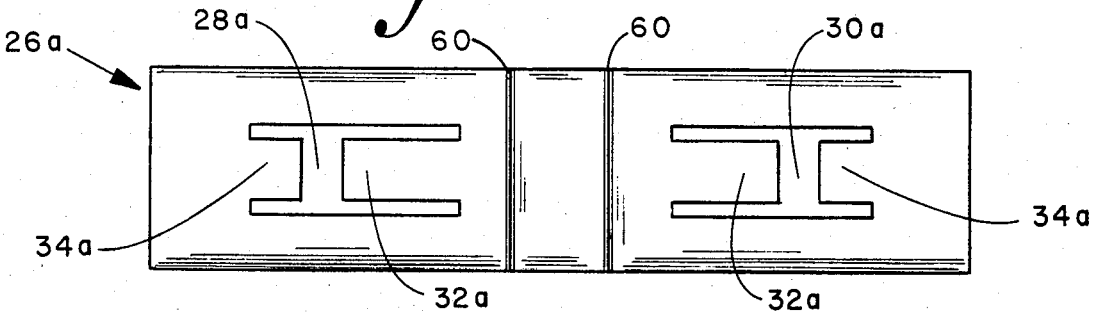
FIG. 9 is an enlarged top plan view of the metal fastener portion of the seal of FIGS. 6–8.
Figure 10:
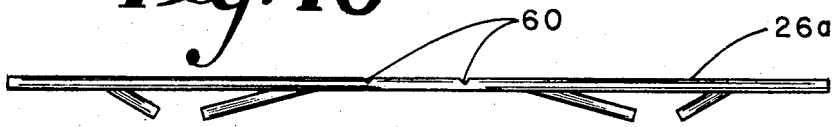
FIG. 10 is a view in side elevation of the seal of FIG. 9.

Referring to FIGS. 6 8 and 11 there is illustrated a modified form of seal which utilizes a shackle **14*a* and a fastener 26*a*, however in this modification the seal body 40 comprises a lower portion 41 which has a cavity 42 in the upper end which forms a peripheral ledge 44, and a pair of openings 46 and 48 extending down into the body from the bottom of the cavity. The cavity 42 and the ledge 44 are dimensioned to receive the fastener 26***a*, and the apertures 46 and 48 are positioned to be aligned with the fastener openings. An upper body portion 50 is provided to fit into the cavity, with apertures 52 and 54 positioned to be aligned with the apertures 46 and 48. The upper portion 50 may be retained in the lower portion in any convenient manner, such as by an adhesive or by heat sealing.

Figure 7:
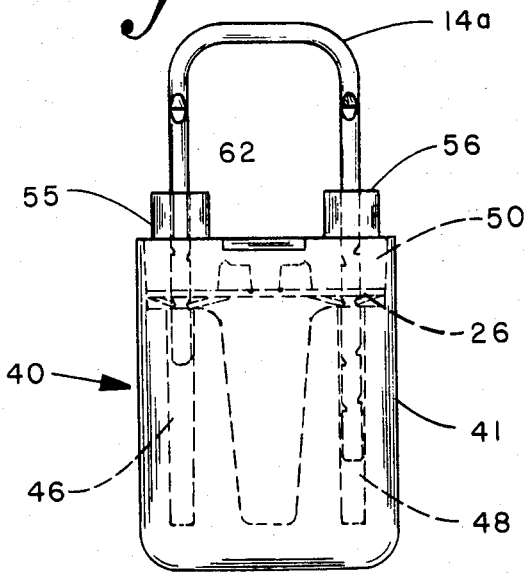
FIG. 7 is a front plan view of the assembly seal of FIG. 6 in the sealed condition.

The shackle 14*a* may be assembled with the seal body of FIGS. 6–8 by placing it in the lower body portion before assembly of the upper body portion. Abutments 54 and 56 may be provided on opposite sides of the openings 52 and 54 for the same purpose as described herein in connection with the abutments 36 of the seal of FIGS. 1 and 4.

In the embodiment of FIGS. 6–8 the fastener 26*a*, in addition to having tongues 32*a* and 34*a* forming openings 28*a* and 30*a*, has a pair of spaced transverse score lines 60 disposed between the apertures.

The under side of the upper body portion 50 is provided with a pair of spaced cavities 62 positioned just above the score lines 60 of the fastener, forming a pair of relatively thin portions 64 in the upper body portion between the shackle openings.

Therefore as illustrated in FIG. 11, when excessive tension is applied to the shackle, the fastener 26*a* will rupture at a score line 60 and the upper body portion will rupture at a thin portion 64, giving obvious evidence of tampering.

In either embodiment of the invention, the fact that the tongue 32 is longer than the tongue 34 causes the tongues to engage the wire shackle at two longitudinally spaced positions, which tends to impart a slight bend to the wire, increasing the holding power of the fastener.

In either embodiment of the invention, the shackle legs may be provided with notches 58 to facilitate engagement with the fastener.

Since certain other changes apparent to one skilled in the art may be made in the herein described embodiments of the invention without departing from the scope thereof, it is intended that all matter contained herein be interpreted in an illustrative and not a limiting sense.

I claim:

1. A seal of the padlock type, comprising a seal body having a pair of spaced openings to receive the legs of a shackle, and an elongated metal fastener in the body having spaced apertures positioned in alignment with the body apertures to receive the shackle legs, and shackle engaging means disposed at the apertures, said fastener and the portion of the body above the fastener having a weakened portion disposed between the shackle apertures, whereby excessive tension applied to a shackle leg will cause fracture of the fastener and the body at the weakened portions.

2. A seal as set out in claim 1 in which a pair of weakened portions are provided in the fastener and the body between the apertures.

3. A seal as set out in claim 2 in which said fastener openings are bounded by flexible tongues dimensioned to nonremovably engage the shackle legs, and said weakened portions comprise a pair of transverse score lines disposed between the apertures.

4. A seal body for a seal of the padlock type for receiving and nonremovably engaging the legs of a U-shaped shackle, comprising a lower body portion and an upper body portion secured thereto and an elongated metal fastener retained between the body portions, said upper and lower body portions and the fastener having aligned openings for receiving the shackle legs, said fastener and said upper body portion having weakened portions disposed between the apertures, whereby excessive tension applied to an assembled shackle will cause rupture of the fastener and the upper body portion at the weakened portions.

5. A seal body as set out in claim 4 in which said lower body portion has a recess in the upper surface, and said upper body portion is retained in said recess, and said upper body portion has a pair of cavities on the lower side forming weakened portions aligned generally with the weakened portions in the fastener.

* * * * *